United States Patent [19]

Roberts

[11] Patent Number: 4,771,881

[45] Date of Patent: Sep. 20, 1988

[54] MATERIALS HANDLING SYSTEM

[76] Inventor: William M. Roberts, 31 Harris Way, Balga, Australia

[21] Appl. No.: 46,888

[22] PCT Filed: Jun. 20, 1986

[86] PCT No.: PCT/AU86/00183

§ 371 Date: Mar. 2, 1987

§ 102(e) Date: Mar. 2, 1987

[87] PCT Pub. No.: WO87/00237

PCT Pub. Date: Jan. 15, 1987

[30] Foreign Application Priority Data

Jul. 8, 1985 [AU] Australia ..... PH01360

[51] Int. Cl.[4] ..... B65G 21/00; B65G 41/00

[52] U.S. Cl. ..... 198/861.1; 198/594; 414/339; 414/342; 414/398; 105/150

[58] Field of Search ..... 198/861.1, 700, 861.2, 198/594; 414/339, 345, 341, 398, 342, 344; 299/78, 43, 45, 64–67; 104/89, 95, 118, 137; 105/148, 150, 154, 239, 84

[56] References Cited

U.S. PATENT DOCUMENTS 1,204,760 11/1916 Greenleaf ..... 414/398
2,724,515 11/1955 Scheuchzer et al. ..... 414/339
4,387,798 6/1983 Jamison et al. .
4,476,975 10/1984 Densmore ..... 198/861.1 X

FOREIGN PATENT DOCUMENTS 19930 9/1975 Australia .
639450 11/1936 Fed. Rep. of Germany ..... 414/339
640313 5/1962 Italy ..... 414/341
918202 4/1982 U.S.S.R. .

*Primary Examiner*—Robert J. Spar
*Assistant Examiner*—Jennifer L. Doyle
*Attorney, Agent, or Firm*—Steele, Gould & Fried

[57] ABSTRACT

A materials handling system primarily for use in tunneling operations for transporting extracted material from a tunnel is disclosed comprising an overhead track from which are suspended an elongated conveyor and a train of mine cars or other transport units. The conveyor conveys materials from a loading zone to a discharge zone. The suspension arrangement for the conveyor and the train of mine cars is such that one mine car can be positioned at a materials receiving station beneath the conveyor for receiving materials discharging therefrom at the discharge zone while the remaining mine cars wait at a queuing station beneath the conveyor for movement in turn to the materials receiving station.

12 Claims, 5 Drawing Sheets

MATERIALS HANDLING SYSTEM

This invention relates to a materials handling system which facilitates transport of materials. The invention has been devised particularly, although not solely, for use in tunnelling operations such as in underground mines.

In underground mining operations, there are various transport systems for transporting extracted materials from the mines. A typical transportation system includes an endless belt loading conveyor which receives extracted materials from a continuous mining machine and delivers the extracted materials to a main transportation system which transports the extracted materials from the mine. Nowadays, the main transportation system generally comprises either an endless belt conveyor system or a rail car system running on tracks laid on the floor of the tunnel. In the case where the main transportation system is in the form of an endless belt conveyor system, it is usual to provide a rail track alongside the conveyor system for manriding and transportation of equipment to and from the mine face. Typically, the loading conveyor is suspended from an overhead monorail which is extended as the tunnel progresses so that the loading conveyor may be progressively advanced in the direction towards the mine face. At certain stages during the mining operation, the main transportation system must also be extended towards the mine face. This involves installation of a further section to the main transportation system, such as the installation of a further conveyor section or a further section of rail track.

The above-mentioned conventional transportation systems are costly to purchase and maintain, and are not altogether satisfactory as the the installation of further sections of the conveyor system and laying of further rail track sections can be awkward, particularly when the tunnel floor condition is poor such as in the case where the floor is under water.

Futhermore, it is necessary to interrupt operation of the main transportation system while it is being extended, and this may involve a significant loss in production time.

A still further disadvantage of conventional transportation systems is that the extensive installations involved with the main transport system are awkward to disassemble and remove when, for example, work on the tunnel ceases.

It is an object of this invention to provide an improved materials handling system which is suspended from an overhead track means so as to be independent of floor conditions and which can be installed relatively easily and quickly.

In one form the invention resides in a materials handling system comprising an overhead track means, an elongated conveying means for conveying materials from a loading zone to a discharge zone, the conveying means being suspended from the overhead track means, a materails transport unit suspended from the track means for movement therealong, the arrangement being such that the movement transport unit can be positioned at a materials receiving station beneath the conveying means for receiving materials discharging therefrom at the discharge zone.

Preferably, the materials handling system further comprises a queuing station beneath the conveying means at which queuing station a further one or more of said transport units can be positioned prior to movement in turn to the material receiving station.

Preferably, the transport units are supported on hangers suspended from the track means.

Preferably, each hanger includes engaging means for releasably engaging the conveying means whereby the hanger provides support for the conveyor.

Preferably, each hanger includes a pair of vertically extending arms spaced to receive the conveying means therebetween when the respective transport unit is at the materials receiving station or at the queuing station.

Preferably, the engaging means includes an engaging member on each arm adapted to supportingly engage a respective longitudinal track on the conveying means whereby the engaging member is movable along the longitudinal track on relative movement between the conveying means and the hanger while providing support for the conveying means.

The engaging member may comprise a roller engagable against a downwardly facing surface of the respective track longitudinal. Each longitudinal track may comprise an outwardly facing channel one wall of which provides said downwardly facing surface against which the roller engages.

The conveying means preferably comprises an endless belt conveyor. Each longitudinal track is preferably constituted by part of the frame structure of the endless belt conveyor.

Preferably, the materials handling system further comprises a supplementary suspension means supporting the conveying means from the overhead track means, the supplementary suspension means comprising at least one supplementary hanger mounted on the track means and supporting the conveying means, the supplementary hanger being movable along the conveying means whereby to provide support for the discharging end thereof when the or each transport unit is remote from the conveying means.

Preferably, said at least one supplementary hanger has a respective engaging member in engagement with each longitudinal track on the conveying means for movement therealong while providing support for the conveying means.

Preferably, the supplementary suspension means includes a plurality of said supplementary hangers for entirely supporting the conveying means when the or each transport unit is remote from the conveying means.

The overhead track means preferably comprises a monorail.

The invention will be better understood by reference to the following description of one specific embodiment thereof as applied to a tunnelling operation for an underground mine such as a coal mine. The embodiment will be described with reference to the accompanying drawings in which.

Figure 1:
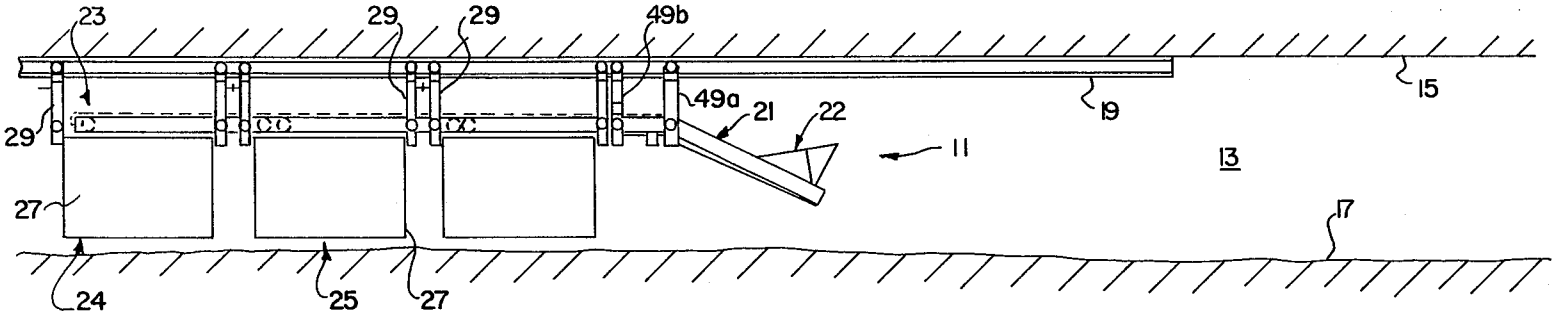
FIG. 1 is a schematic sectional view of a material handling system installed in an underground mine, showing the system at one stage of operation.
Figure 2:
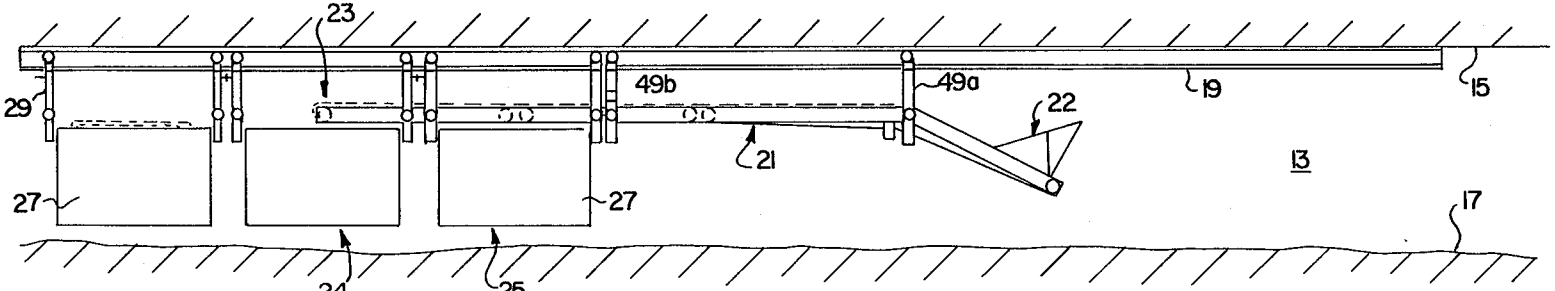
FIG. 2 is a view similar to FIG. 1, except that the materials handling system is shown at a further stage of operation.

Referring to the drawings, the materials handling system 11 is installed in a mine tunnel 13 having a roof 15 and a floor 17.

The materials handling system 11 includes an overhead track means 19 in the form of a monorail anchored to the tunnel roof 15. The monorail 19 is formed from a series of monorail sections and can be extended as the tunnelling operation progresses.

An elongated conveying means 21, which is in the form of an endless belt conveyor, is suspended from the monorail 19 and can be moved therealong. The endless belt conveyor is supported in an elevated position and has a loading zone 22 and a discharge zone 23. The endless belt conveyor receives extracted materials at the loading zone 22 from a continuous mining machine (not shown) which operates ahead of the endless belt conveyor and dumps materials extracted from the mine face onto the loading zone.

Provided below the endless belt conveyor are a materials receiving station 24 and a queuing station 25.

Figure 4:
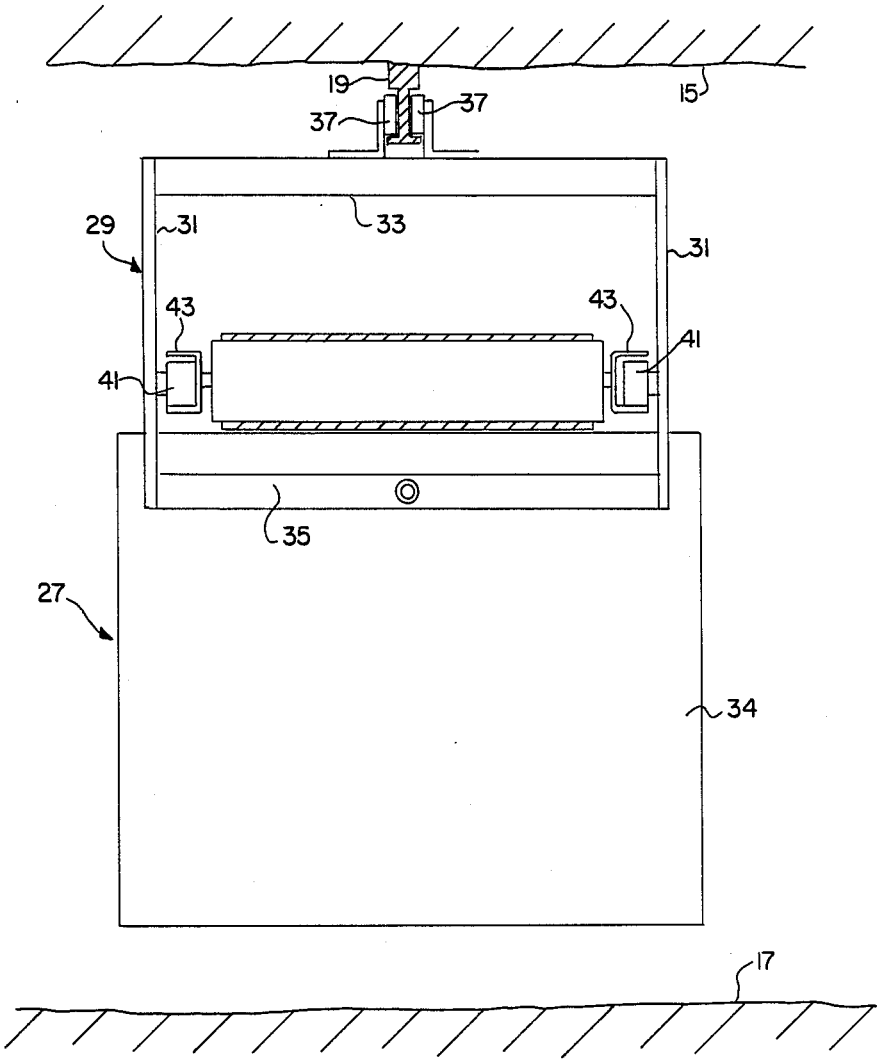
FIG. 4 is an end view on an enlarged scale of the material handling system.

Also suspended from the monorail 19 for movement therealong are a plurality of transport units 27 in the form of mine cars (which are commonly known as tubs). The mine cars 27 form a train which can be hauled along the monorail, there being three mine cars in the train in this embodiment. It will be understood that the size of the queuing station governs the maximum number of mine cars in each train. The mine cars 27 are suspended from the monorail 19 by means of hangers 29 at the ends of the mine cars. Each hanger 29 is substantially rectangular when viewed along the longitudinal extent of the monorail (as shown in FIG. 4) and comprises a pair of spaced vertically extending arms 31 fixed at the ends thereof to upper and lower transverse members 33 and 35 respectively. The upper transverse member 33 supports a pair of rollers 37 in rolling engagement with the monorail in a so-called trapped rail fashion. The lower transverse member 35 is secured to an end wall 34 of the respective mine car 27. The vertically extending arms 31 of each hanger are suitably spaced to receive the elongated conveyor 21 therebetween (as shown in FIG. 4) so as to allow positioning of the mine cars 27 below the elongated conveyor, with one mine car at the materials receiving station 24 and the remaining mine cars (being two cars in this embodiment) at the queuing station 25.

Figure 5:
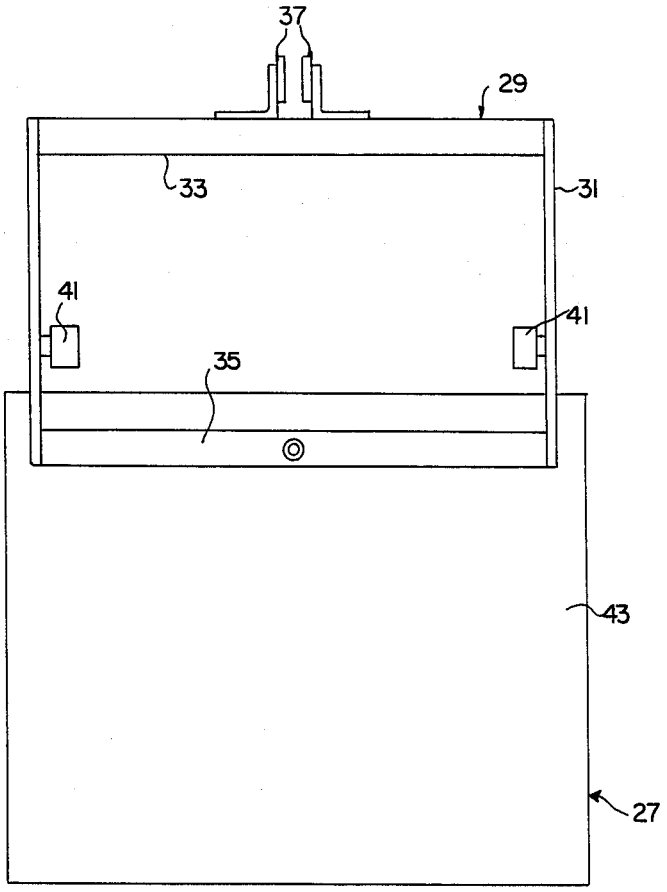
FIG. 5 is an end view of a transport unit and hanger therefor.
Figure 6:
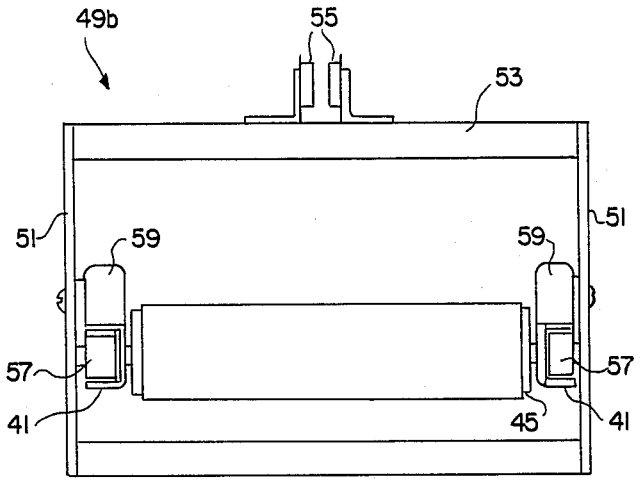
FIG. 6 is an end view of the conveying means and suspension system therefor when the transport units are remote from the conveying means.

Each hanger 29 is provided with engaging means for engaging the endless belt conveyor so as to provide support therefor, when the respective mine car is at the materials receiving station or the queuing station. The engaging means comprises a pair of engaging rollers 41, one mounted on the inside of each vertically extending arm 31 of the respective hanger, as best seen in FIG. 5.

The endless belt conveyor 21 comprises a pair of longitudinally extending side frame members 43 each in the form of an outwardly facing channel, as best seen in FIG. 4 of the drawings. Each side frame member 43 constitutes a longitudinal track which is engageable by a respective one of the engaging rollers 41 on the hangers 29 whereby the engaging rollers provide support for the endless belt conveyor when in engagement with the longitudinal track. The endless belt conveyor further comprises a head roller 45, a tail roller 46 and idler rollers 47 supported between the longitudinal side frame members 43.

Figure 3:
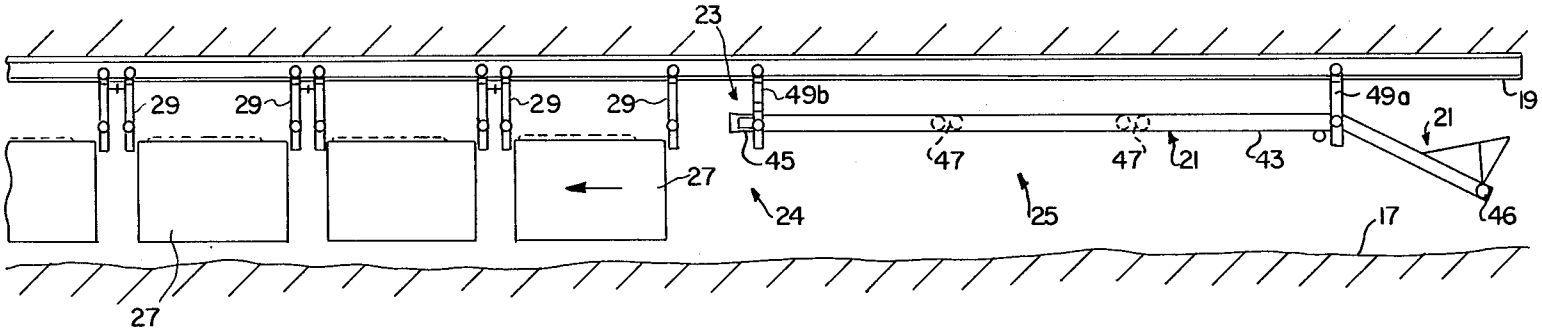
FIG. 3 is also a view similar to FIG. 1, except that the materials handling system is shown at a still further stage of operation.

A supplementary suspension means is provided for supporting the endless belt conveyor. The supplementary suspension means comprises two supplementary hangers 49 suspended from the monorail 19 for movement therealong to provide support for the endless belt conveyor. The supplementary hanger **49*a* which is closer to the loading zone of the endless belt conveyor is fixed to the endless belt conveyor. The other supplementary hanger 49*b* is movable along the endless belt conveyor. The supplementary hanger 49*b* compries a pair of vertically extending arms 51 fixed at the upper end thereof to a transverse member 53. The transverse member 53 supports a pair of rollers 55 which are in rolling engagement with the monorail. Adjacent the lower end of each vertically extending arm 51 there is provided an engaging member 57 in engagement with a respective one of the longitudinal tracks 43 on the endless belt conveyor. The engaging member 57 is in the form of a roller and is movable along the longitudinal track while providing support for the endless belt conveyor. Stops 59 on the longitudinal tracks 43 prevent the movable supplementary hanger 49*b* from disengaging from the longitudinal tracks at the ends thereof. When the movable supplementary hanger 49*b* is moved along the length of the endless belt conveyor to occupy a position remote and preferably furthermost, from the fixed supplementary hanger 49*a*, the supplementary hangers entirely suppor the endless belt conveyor when the mine cars 27 and their respective hangers 29 are remote from the endless belt conveyor, as shown in FIG. 3 of the drawings. When the mine cars are moved into the queuing and materials receiving stations, the movable supplementary hanger 49*b* is moved along the longitudinal tracks 43 into a position alongside the fixed supplementary hanger 49*a*, as shown in FIG. 1 on the drawings. In this position, the supplementary hangers 49 together with the hangers 29** support the endless belt conveyor in an elevated position in relation to the tunnel floor.

There may be one or more further movable supplementary hangers intermediate the fixed supplementary hanger **49*a* and the movable supplementry hanger 49*b***.

Operation of the materials transport system will now be described. The endless belt conveyor 21 is positioned behind a continuous mining machine (not shown) so that materials extracted from the mine face by the continuous mining machine are delivered to the delivery zone 22 of the endless belt conveyor. The train of mine cars are positioned below the endless belt conveyor so that one mine car is at the material receiving station 24 and the other mine cars are at the queuing station 25. The endless belt conveyor loads the materials into the mine car at the materials receiving station. When the mine car at the materials receiving station is fully loaded, the mine cars are moved relative to the endless belt conveyor so as to bring the next mine car at the queuing station into the materials receiving station for loading thereof. This operation continues until all mine cars are loaded. As each mine car moves away from the endless belt conveyor, its respective hangers 29 move out of engagement with the longitudinal tracks 43 on the endless belt conveyor and thereby the hangers no longer provide support for the endless belt conveyor. The movable supplementary hanger **49*b* is detachably connected to the train of mine cars and moves relative to the endless belt conveyor with the mine cars until such time as it reaches its position furthermost from the fixed supplementary hanger 49***a*, which position is determined by the stops 59 and corresponds to the final mine car arriving at the materials receiving station.

When the final mine car is fully loaded, the movable supplementary hanger is detached from the mine car so as to allow the train of mine cars to move away from the endless belt conveyor. When the mine cars are remote from the endless belt conveyor, the supplementary hangers entirely support the endless belt conveyor, as shown in FIG. 3 of the drawings. The train of mine cars may be hauled to a dump zone at which their loads are dumped and the mine cars are then returned to the materials receiving station and the queuing station. The loading opertion is then repeated.

From the foregoing, it is evident that a materials handling system according to the present invention allows the endless belt conveyor and the mine cars to be supported from a common monorail. This provides cost benefits. In addition, the common monorail facilitates relatively rapid installation and dismantling of the transport system. Furthermore, because the endless belt conveyor and the mine cars are supported from the overhead monorail, installation and operation of the materials handling system is not affected by tunnel floor conditions.

It is envisaged that in mining applications, the number and capacity of the mine cars or other transport units would be selected so as to accommodate materials extracted from a mine face in one working shift. In this way, the mine cars would only be required to be hauled from the mine for unloading thereof once each working shift.

It will be appreciated that the scope of the convention is not limited to the scope of the embodiment described.

I claim:

1. A materials handling system comprising: an overhead track, an elongated conveyor suspended from the overhead track for movement therealong, a materials transport means for receiving materials discharging from the conveyor, the transport means being suspended by first suspension means from the track for movement therealong and being receivable beneath the conveyor, the first suspension measn including engaging means for releasably engaging the conveyor thereby to suspend the conveyor from the track when the transport means is beneath the conveyor, and second suspension means for suspending the conveyor form the track an dfor supporting the conveyor at least when the first suspension means is out of engagement with the conveyor.

2. A materials handling system according to claim 1 wherein the material transport means includes a plurality of transport units connected one to another.

3. A materials handling system according to claim 2 wherein a queuing station is defined beneath the conveyor where at least some of said transport units can be positioned prior to movement in turn to a materials receiving station for receiving materials discharging from said conveyor.

4. A materials handling system according to claim 1 wherein the first suspension means comprises a plurality of hangers mounted on the track for movement therealong, each hanger including a pair of vertically extending arms spaced to receive the conveyor therebetween.

5. A materials handling system according to claim 4 wherein the engaging means includes an engaging member for each arm adapted to supportingly engage a respective longitudinal track on the conveyor whereby the engaging member is movable along the longitudinal track on relative movement between the conveyor and the hanger while providing support for the conveyor.

6. A materials handling system according to claim 5 wherein each engaging member includes a roller engageable against a downwardly facing surface of the respective longitudinal track.

7. A materials handling system according to claim 6 wherein each longitudinal track includes an outwardly facing channel, one wall of which provides said downwardly facing surface against which the roller engages.

8. A material handling system according to claim 5 wherein said second suspension means includes at least one supplementary hanger mounted on the overhead track for movement therealong, the supplementry hanger being movable along the length of the conveyor to provide support for a discharging end of the conveyor.

9. A materials handling system according to claim 8 wherein said at least one supplementry hanger has a respective engaging member in engagement with each longitudinal track on the conveyor for movement therealong while providing support for the conveyor.

10. A materials handling system according to claim 4 wherein the conveyor comprises an endless belt conveyor.

11. A materials handling system according to claim 10 wherein a longitudinal track comprises part of a frame structure of the endless belt conveyor.

12. A materials handling system according to claim 1 wherein the overhead track comprises a monorail.

* * * * *